United States Patent [19]

Werda

[11] 4,071,726

[45] Jan. 31, 1978

[54] ELECTRICAL SWITCH HAVING ACTUATOR LIGHT TRANSMISSIVE REGION, INTERMEDIATE LENS AND LIGHT SOURCE

[75] Inventor: Konrad Werda, Clitheroe, England

[73] Assignee: Lucas Electrical Company, Limited, England

[21] Appl. No.: 653,603

[22] Filed: Jan. 29, 1976

[30] Foreign Application Priority Data

Feb. 11, 1975 United Kingdom ..... 5711/75

[51] Int. Cl.[2] ..... H01H 9/16; G09F 9/00

[52] U.S. Cl. ..... 200/311; 116/DIG. 28; 116/124 L; 200/313; 200/314

[58] Field of Search ..... 200/313–317, 200/DIG. 47, 308, 311; 350/266; 116/124 L, DIG. 28

[56] References Cited

U.S. PATENT DOCUMENTS

| | | | |
|---|---|---|---|
| 3,144,643 | 8/1964 | Andersson | 200/314 X |
| 3,169,506 | 2/1965 | Morris | 350/266 X |
| 3,305,677 | 2/1967 | Bov | 200/314 |
| 3,372,260 | 3/1968 | Bell | 200/316 |
| 3,610,860 | 10/1971 | Baldwin | 200/315 |
| 3,780,248 | 12/1973 | Martin | 200/311 |
| 3,845,736 | 11/1974 | Golbeck et al. | 200/308 X |
| 3,895,204 | 7/1975 | Lewis | 200/314 |

FOREIGN PATENT DOCUMENTS

| | | | |
|---|---|---|---|
| 1,268,996 | 6/1961 | France | 200/314 |
| 2,434,739 | 1/1976 | Germany. | |
| 959,077 | 5/1964 | United Kingdom. | |
| 1,169,457 | 11/1969 | United Kingdom. | |

OTHER PUBLICATIONS

The Way Things Work, "Lenses", Simon & Schuster, 1967, pp. 136, 137; vol. 1.

*Primary Examiner*—James R. Scott
*Attorney, Agent, or Firm*—Holman & Stern

[57] ABSTRACT

An electrical switch has an operating member movable between two positions and includes a light transmissive region in the operating member. The region is illuminated by a light source acting through a lens. Movement of the operating member between the two positions changes the relative position of the lens and the light source such that the area and intensity of the light on the light transmissive portion is varied in said two positions. This variation provides a visible indication of the operative position of the switch.

4 Claims, 2 Drawing Figures

FIG. 1.
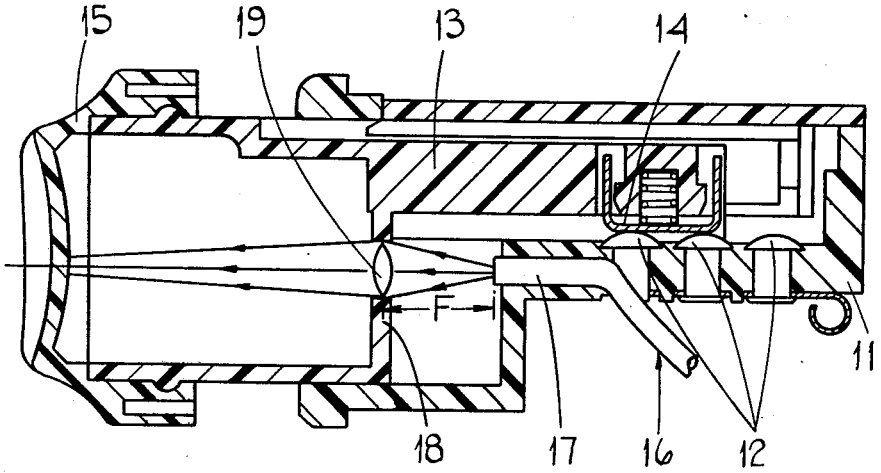
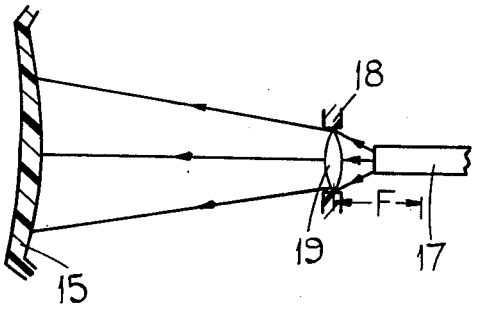
FIG. 2.

ELECTRICAL SWITCH HAVING ACTUATOR LIGHT TRANSMISSIVE REGION, INTERMEDIATE LENS AND LIGHT SOURCE

SUMMARY OF THE INVENTION

This invention relates to an electrical switch.

An electrical switch according to the invention includes a body, an operating member mounted in the body for movement relative thereto between first and second spaced positions, a light transmissive region in the operating member, said region being visible in both of the first and second operative positions of the operating member relative to the body, and, a lens and a light source, one of the pair of components defined by the lens and the light source being carried by the operating member, and the other of the pair of components being carried by the body, the lens and the light source being so arranged that in use light from the light source passes through the lens and illuminates the transmissive region of the operating member, and relative movement of the operating member and the body resulting in relative movement of the lens and the light source in the direction of the optical axis of the lens so altering the area of the transmissive region which is illuminated whereby a visible indication of the position of the operating member relative to the body is given.

Preferably the relative movement of the operating member and the body alters the spacing of the light source and the lens between a spacing which is less than the focal length of the lens and a spacing which is in excess of the focal lengh of the lens.

DESCRIPTION OF THE DRAWINGS

One example of the invention is illustrated in the accompanying drawings, wherein, FIG. 1 is a partly diagrammatic cross-sectional representation of an electrical switch with its operating member in a first position; and FIG. 2 is a partial view illustrating parts of the switch shown in FIG. 1, but in a second position.

DETAILED DESCRIPTION OF A PREFERRED EMBODIMENT

Referring to the drawings, the electrical switch includes a moulded synthetic resin body 11 carrying fixed electrical contacts 12. A moulded synthetic resin operating member 13 is linearly slidable within the body and carries a moving bridging contact 14 resiliently urged at right angles to the direction of movement of the operating member 13 towards the plane of the fixed contacts 12. At its end remote from the movable contact 14 the operating member 13 is hollow, and extends from the body 11. At its outermost end the hollow part of the operating member 13 is closed by a translucent moulded synthetic resin cover 15 which is a snap fit on the remainder of the operating member 13.

The body 11 and operating member 13 are provided with co-operating detent parts (not shown) for retaining the operating member in either of first and second spaced operative positions relative to the body 11. A compression spring (not shown) urges the operating member outwardly of the body to its first operative position, and the operating member is depressible into the body 11 against the action of the compression spring to its second operative position. In the first operative position, the contact 14 bridges a first pair of the contacts 12 and so completes a first electrical circuit through the switch, and in the second operative position, the contact 14 bridges a second pair of the fixed contacts 12 so completing a second electrical circuit through the switch.

The body 11 supports one end 17 of an optical cable 16, parallel to the axis of movement of the operating member. The operating member 13 includes a wall portion 18 extending at right angles to the direction of movement of the operating member and having therein a window containing a converging lens 19 having its optical axis co-extensive with the axis of the end 17 of the optical cable 16. Thus in use light issuing from the end 17 of the optical cable impinges on the lens 19. The light impinging on the lens 19 is directed by the lens 19 through the hollow interior of the operating member 13 to fall upon the translucent cover 15. Thus the cover 15 constitutes a translucent screen for the optical system defined by the lens and the source of light.

It will be understood that movement of the operating member 13 relative to the body between its first and second positions will result in movement of the lens 19 towards and away from the light source 17, and since the light issuing from the light source 17 is not parallel light then the illumination of the screen defined by the cover 15 will be altered accordingly. The arrangement is such that in the first position of the operating member, as shown, spacing of the lens from the light source 17 is greater than the focal length F of the lens and so there is a relatively small area of illumination on the screen defined by the cover 15. Thus when viewed from the exterior of the switch a relatively small spot of intense illumination is seen on the end surface of the cover 15. Movement of the operating member to its second operative position reduces the spacing between the lens 19 and the light source 17 to a spacing less than the focal length F of the lens 19, so that in the second operative position there is a relatively large area of illumination on the screen defined by the cover 15 and the end surface of the cover 15 appears diffusely illuminated. The operator viewing the exterior of the cover 15 will therefore be able to identify the operative position of the operating member from the nature of the illumination of the cover 15. In the second operative position the whole of the front surface of the cover 15 will be illuminated diffusely, whereas in the first operative position there will be a small spot of relatively intense illumination on the cover 15. Moreover, it will be understood that if desired the lens can be carried by a part of the body 11, while the light source is carried by the operating member.

In a modification the lens 19 is replaced by an elongate, so-called cylindrical convex lens so that in the one position of the lens relative to the light source the lens produces a relatively narrow band of intense illumination on the cover 15. In the other position once again there is a diffuse illumination of substantially the whole of the area of the cover.

The switches described above are suitable for use in a wide variety of applications where it is necessary to give a visual indication of the operative condition of the switch. The switches for example will find use in automobile applications for controlling a wide variety of electrical operations of the vehicle, for example control of a heated rear window.

I claim:

1. An electrical switch assembly having indicator means comprising:

a body;

an operating member, mounted in said body, for movement relative thereto between first and second spaced positions;

a light transmissive region, located in said operating member, visible in both of said first and second operative positions;

light source means for emitting light and illuminating said light transmissive region;

lens means, disposed between said light source means and said light transmissive region and responsive to the distance from said light source means, for modifying the light illuminating said light transmissive region into varying levels of exposure area on said light transmissive region; and spacing means, responsive to said operating member, for varying said distance between said light source means and said lens means.

2. The electrical switch of claim 1 wherein said lens means has a focal length and said spacing means varies said distance from less than said focal length to greater than said focal length.

3. An electrical switch assembly having indicator means comprising:

a body;

an operating member, mounted in said body, for movement relative thereto between first and second spaced positions;

a light transmissive region, located in said operating member, visible in both of said first and second operative positions;

light source means for emitting light and illuminating said light transmissive region;

lens means, disposed between said light source means and said light transmissive region and responsive to the distance from said light source means, for modifying the light illuminating said light transmissive region into varying levels of exposure area on said light transmissive region, said operating member further varying said distance between said light source means and said lens means.

4. The electrical switch of claim 3 wherein said lens means has a focal length and said operating member varies said distance for less than said focal length to greater than said focal length.

* * * * *